United States Patent [19]

Blitzer et al.

[11] Patent Number: 4,949,517

[45] Date of Patent: Aug. 21, 1990

[54] WIRE GRID SUBCEILING PANEL

[76] Inventors: Jacob H. Blitzer, 400 S. Saltair, Los Angeles, Calif. 90049; Richard M. O'Toole, 4495 Huntley Ave., Culver City, Calif. 90230

[21] Appl. No.: 457,845

[22] Filed: Dec. 27, 1989

[51] Int. Cl.[5] ..... E04C 2/00; E04B 9/00; E08B 1/00

[52] U.S. Cl. ..... 52/644; 52/665; 52/484; 52/488

[58] Field of Search ..... 52/664, 665, 488, 106, 52/484

[56] References Cited

U.S. PATENT DOCUMENTS

| | | | |
|---|---|---|---|
| 657,923 | 9/1900 | Escher | 52/665 |
| 856,130 | 6/1907 | Canda | 52/106 X |
| 2,158,229 | 5/1939 | Goldthwaite | 52/664 X |
| 3,173,226 | 3/1965 | Solnick | 52/664 X |
| 3,594,970 | 7/1971 | MacGrath | 52/665 X |
| 3,969,863 | 7/1976 | Alderman | 52/665 X |
| 4,665,674 | 5/1987 | Brugman | 52/488 |
| 4,773,200 | 9/1988 | Young | 52/484 |

FOREIGN PATENT DOCUMENTS

| | | | |
|---|---|---|---|
| 493916 | 2/1977 | Australia | 52/664 |
| 216728 | 1/1961 | Austria | 52/664 |
| 457194 | 6/1949 | Canada | 52/664 |
| 2603058 | 8/1977 | Fed. Rep. of Germany | 52/664 |
| 1095575 | 12/1954 | France | 52/664 |
| 249307 | 6/1947 | Switzerland | 52/665 |

*Primary Examiner*—David A. Scherbel
*Assistant Examiner*—Deborah McGann Ripley

[57] ABSTRACT

Ceiling panels, formed from metal rods welded together in a grid pattern, are easily installed in suspended subceilings of the type in which panels are supported on bottom flanges of a framework of inverted T-bar rails. In a lower layer of the panel, an array of spaced parallel rods is tied together across each end by an end rod to form a perimeter which fits within a cell opening of the inverted T-barsupport framework, while rods in an adjoining upper layer of the panel, oriented perpendicular to the rod array in the lower layer, are made to extend beyond the lower layer perimeter so as to support the panel, along two opposite panel edges, upon the upper side of bottom flanges of the support frame rails. The perimeter rods in the lower layer in combination with with the exposed portion of the support rail flanges produce the finished effect of a uniform border around each panel. The wire grid panels may be utilized exclusively in a subceiling for an "open plenum" effect or intermixed with conventional solid panels such as acoustical board to provide desired architectural patterns. For noise reduction or avoiding an open plenum view, some or all of the wire grid panels in a subceiling may be overlaid with standard acoustical board. Also, the wire grid panels may be utilized in combination with special rail flange coverings such as the MINIATURE CEILING T-BAR COVER CAP, U.S. Pat. No. 4,848,054 to Blitzer and O'Toole.

8 Claims, 3 Drawing Sheets

WIRE GRID SUBCEILING PANEL

FIELD OF THE INVENTION

The present invention, in the field of suspended subceilings, relates to panels having a particular wire grid configuration.

BACKGROUND OF THE INVENTION

Ongoing architectural evolution creates new unsatisfied needs for special panel configurations for suspended ceilings to satisfy particular environmental and aesthetic requirements and at the same time provide improvements in essential parameters such as ease of installation, safety, and cost effectiveness.

Suspended ceilings commonly utilize a framework of inverted T bar rails to support panels which are typically of standard size such as 2'×2' or 2'×4'. As a departure from conventional basic flat solid panels or acoustical boards fabricated from fibrous or composition materials, panels providing special geometric decorative treatments have utilized open patterns such as louvered or gridded arrays, typically employing metal or plastic members in rectangular or strip form.

The present invention addresses a new alternative to such known panels to create a visual ceiling plane configured as an open grid pattern of crossed wires or rods interacting functionally and architecturally in combination with inverted T bar framework to provide a particular desired finished form and appearance.

OBJECTS OF THE INVENTION

It is a primary object of the present invention to provide a novel panel construction, in a suspended ceiling utilizing inverted T bar support framework, creating a visual ceiling plane appearance of crossed rods in an open grid pattern.

It is a further object to provide on the novel panel a perimeter of rods which combines with surrounding exposed flange surfaces of the T bar framework to provide a uniform visual border at all four edges of the panel.

It is a still further object that panels of the novel construction be readily produceable and easily installable in a suspended subceiling framework of the inverted T bar type.

An understanding of how the present invention has accomplished these and other objects and advantages will become apparent from a study of the following description with reference to the accompanying drawings.

DETAILED DESCRIPTION

Figure 1:
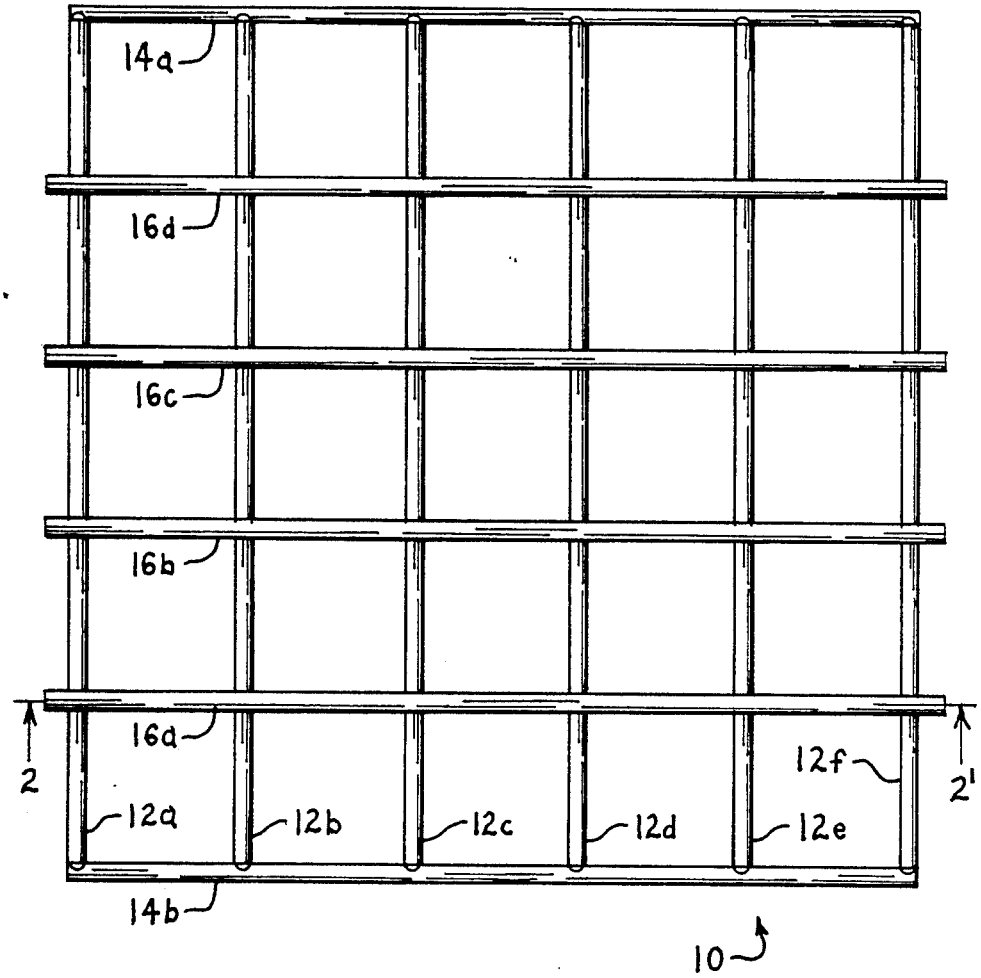
FIG. 1 is a plan view of a wire grid subceiling panel of the present invention, as viewed from above.

The plan view of FIG. 1 shows a nominally square panel 10 made from rod material, illustrative of a preferred embodiment of the present invention, viewed from above.

Panel 10 is seen to comprise twelve longitudinal rod members: eight of these are disposed in a lower layer and four in an upper layer immediately above the lower layer: in the lower layer, six identical parallel members **12*a*–12*f* are uniformly spaced in an array, joined at their ends to transverse members 14*a* and 14*b*, one at each end of the array, so as to form in the lower layer a perimeter comprising members 14*a*, 12*f*, 14*b* and 12*a*. In the upper plane, four identical parallel members 16*a*–16*d* are uniformly spaced as shown, oriented perpendicular to members 12*a*–12*f*, members 16*a*–16*d* being dimensioned in length to extend beyond perimeter members 12*a* and 12*f*** of the lower layer.

Figure 2:
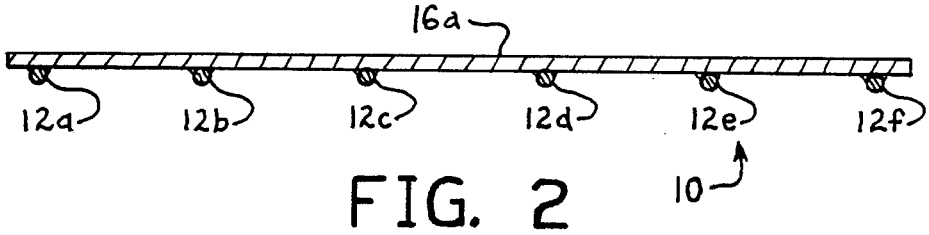
FIG. 2 is a cross sectional side view through 2—2' of FIG. 1.

In FIG. 2, a cross section of panel 10 through 2—2' of FIG. 1 shows rod member **16*a* in the upper layer immediately above the lower layer rod members 12*a*–12*f* and in contact with them where they cross perpendicularly: typically the upper layer rods and lower layer rods are welded together at each crossing intersection, such as the six shown, to form a flat rigid grid structure which can serve as a panel. The ends of upper layer rod 16*a* are seen extending beyond the perimeter rods 12*a* and 12*f*** in the lower layer.

Figure 3:
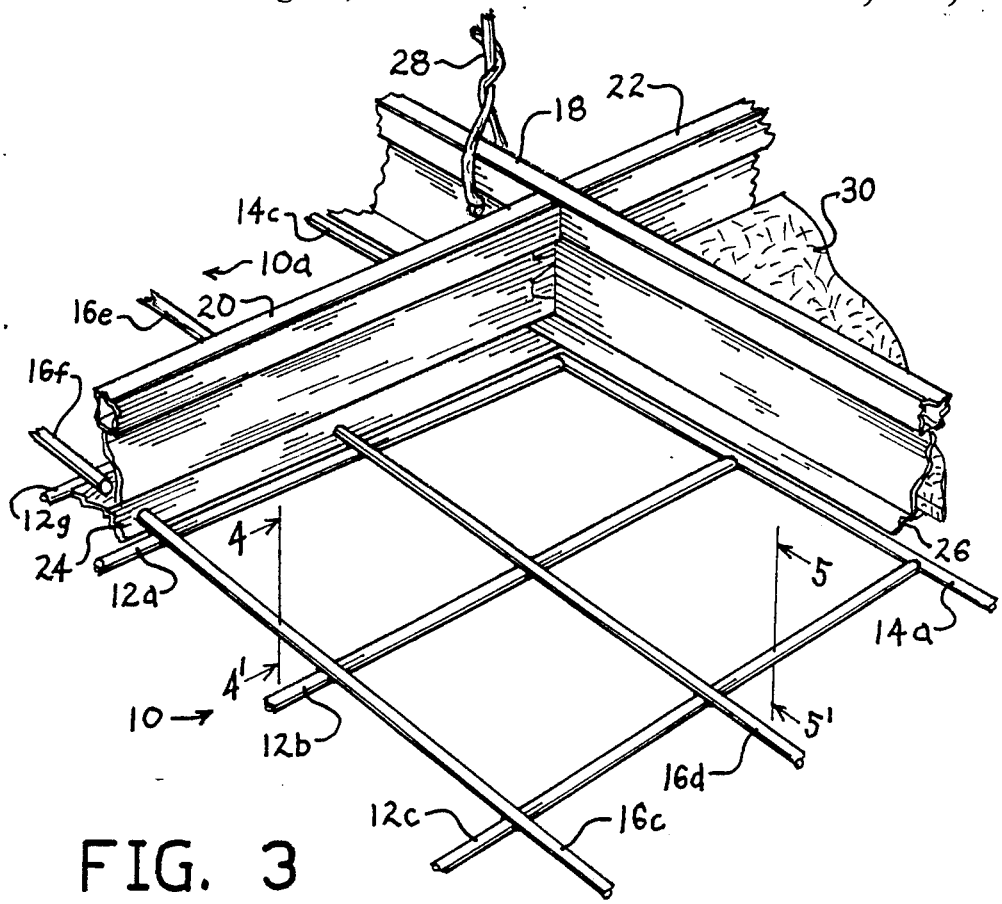
FIG. 3 is a perspective view of a corner portion of the wire grid panel of FIG. 1 in an installed position along with an adjacent intersecting portion of inverted T-bar support framework, as viewed from above.

The perspective view of FIG. 3 shows a portion of a suspended ceiling, containing wire grid panels of the present invention, including a rail intersection as viewed from above. A corner portion of panel 10 of FIG. 1, is shown in its installed position adjacent to a corresponding portion of the support framework, i.e. runner rail 18 disposed perpendicular to colinear cross rail members 20 and 22 so as to form an intersection as shown. The subceiling framework is suspended from overhead building structure by wire hangers such as hanger 28 in a conventional manner.

The extended ends of rods **16*c* and 16*d* of panel 10 and rod 16*f* of an adjacent wire grid panel 10*a* seen resting on flange 24 are typcial of the manner in which the upper layer rods support panels on the upper side of rail flanges. It should be apparent that the lower layer drops into the cell opening at the approximate level of the rail flanges, with the perimeter members adajacent to the flanges, as typified by lower layer rod members 12*a* and 12*g* flanking flange 24 and end rod members 14*a* and 14*c*, of panels 10 and 10*a* respectively, adjacent to flange 26. Also shown in the lower level are rod members 12*b* and 12*c* of panel 10. In the cell opening to the right of the intersection of rails 18 and 22 is shown a portion of a conventional panel 30**, set in place on top of the rail flanges in accordance with normal practice.

Figure 4:
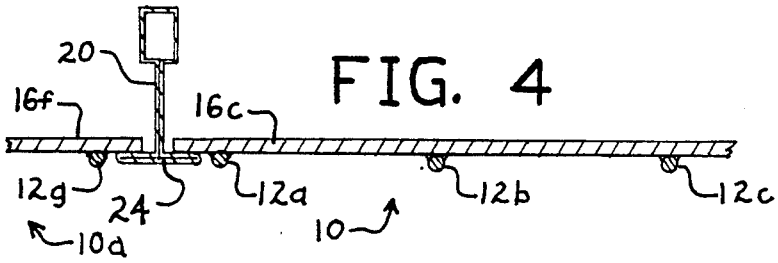
FIG. 4 is a cross sectional view through 4—4' of /FIG. 3.

The cross sectional view in FIG. 4, taken through 4—4' of FIG. 3, shows the extended ends of upper layer rods **16*f* and 16*c* resting on the upper side of flange 24 of rail 20, supporting lower layer rods 12*g*, 12*a*, 12*b* and 12*c* at the approximate level of flange 24, which is flanked by the perimeter rod members 12*g* and 12*a* of the two adjacent wire grid panels 10*a* and 10** respectively.

Figure 5:
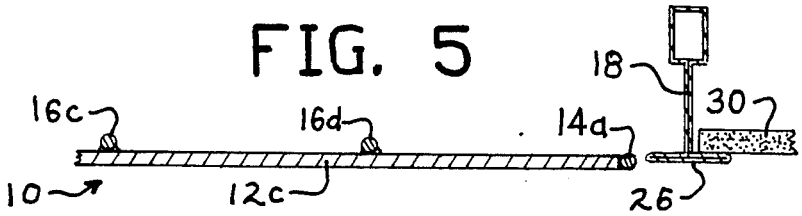
FIG. 5 is a cross sectional view through 5—5' of FIG. 3.

The cross sectional view in FIG. 5, taken through 5—5' of FIG. 3, shows, in this portion of panel 10, two upper layer rods **16*c* and 16*d* attached to the top side of lower layer rod 12*c*. End rod 14*a*, attached to the end of rod 12*c* is seen adjacent to the left of flange 26 of rail 18**.

To the right of rail 18 is seen the portion of conventional panel 30, resting on flange 26.

Figure 6:
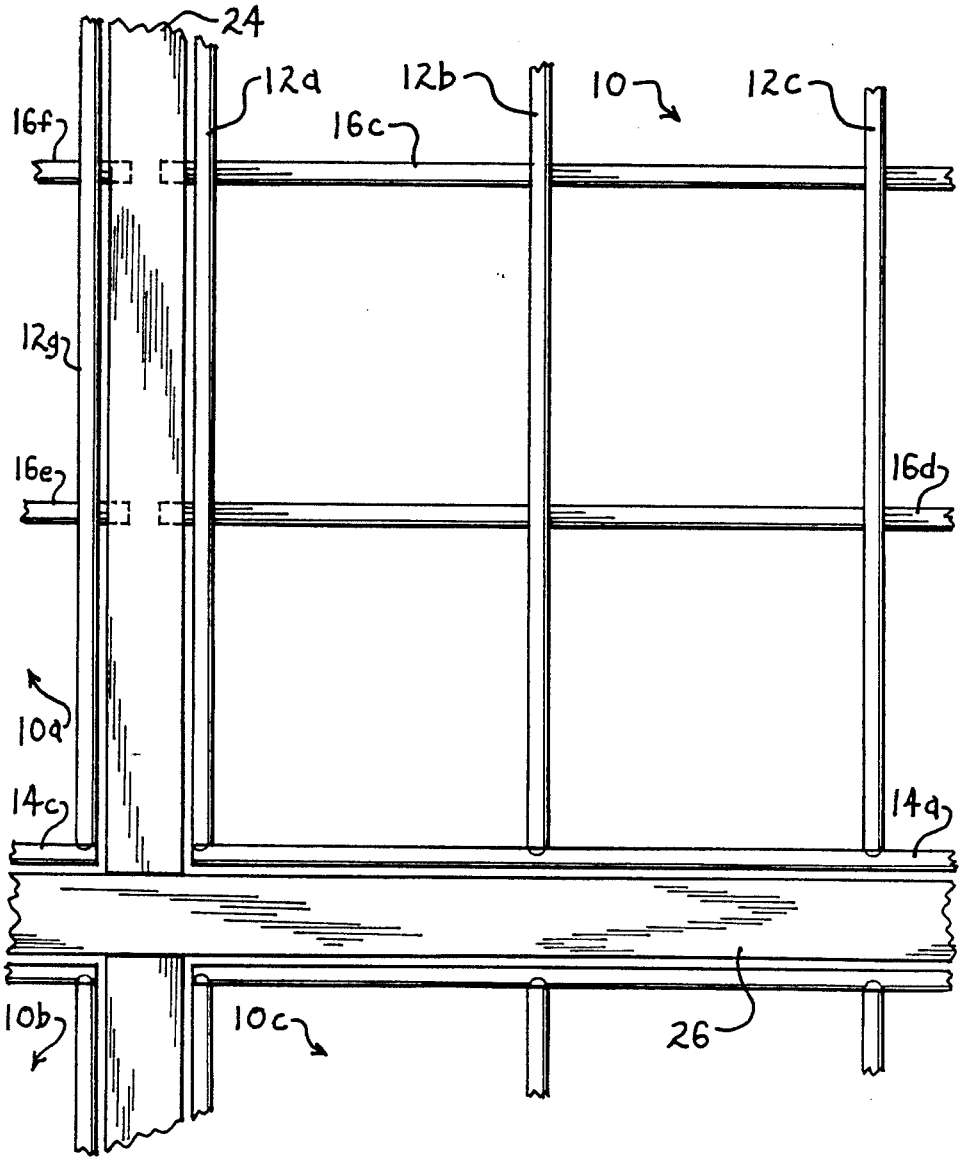
FIG. 6 is a bottom view of a portion of a subceiling containing panels of this invention.

FIG. 6, a bottom view of a portion of subceiling containing wire grid panels, illuustrates the finished appearance as viewed from the room space below. The portion shown corresponds with FIG. 3 with the exception that conventional panel 30 is not shown: instead all four cells of the intersection are shown equipped with wire grid panels 10, 10*a*, 10*b* and 10*c*. The perimeter members such as 12*a*, 12*g* and 14*a* seen adjacent to beam flanges 24 and 26, forming the desired uniform border effect all around the panel perimeters as sought by this invention. The manner of panel support is illustrated by the dashed outlines of the extended ends of upper layer rods 16*c*, 16*d*, 16*e* and 16*f*, which, resting on the top side of rail flange 24, are concealed from normal view.

It is seen that, in the installed position shown, the panel receives support by the extended ends of upper layer rods 18*a*–18*d* resting on the upper side of the bottom flanges of the support rails, exemplified by rod members 18*c* and 18*d* resting on flange 26 as shown in dashed outline.

Typically all rod members of the panel are made of steel or other metal material, and each point of intersection or abuttment between two members is welded together.

In the particular embodiment described above, the rods are made 0.25" in diameter, and for a nominal 2' square panel support framework, the outside perimeter of the lower layer is made approximately 25.75" by 22.75" to fit the cell openings of standard support frameworks having a T-bar flange width of 15/16", resulting in a grid cell size of about 4.5" square. The upper layer rod members are made to extend sufficiently beyond the perimeter of the lower layer to provide a safe bearing overlap on the rail flanges, typically 0.3".

Panels of this invention may be made practically interchangeable with conventional solid panels, and thus readily installable into the support framework in generally the same drop-in manner as conventional solid panels; however, since the panels of the present invention are sized overall to extend beyond the cell openings on only two opposite sides and to provide a clearance fit within the cell openings on the other two sides, installation and removal from below is actually easier than with conventional panels which extend beyond the cell openings on all four sides.

The completed panels are typically painted or otherwise finished to provide desired protection and appearance.

It is contemplated that in some instances an entire subceiling may be fitted exclusively with wire grid panels of the present invention to create an "open plenem" effect, while in other in other instances the wire grid panels may be selectively intermixed with conventional panels to create particular ceiling patterns for architectural purposes. As a further option, the wire grid panels may be overlaid with conventional panels, for example with standard acoustical board when noise reduction or elimination of all view of the plenum space is desired.

Furthermore, panels of the present invention may be utilized in combination with with special decorative rail flange coverings, particularly the MINIATURE CEILING T-BAR COVER CAP, U.S. Pat. No. 4,848,054 to Blitzer and 0'Toole, trademarked as T-Beam.

While a particular panel size and number of rods has been described above as an illustrative embodiment, the two-layer construction principle of the invention is equally applicable to panels of other sizes and different numbers of rods. Typically the number of rods in the upper layer is $n-2$ in a square panel whose layer contains n identical parallel rods plus two end rods.

Whether the panels are square or rectangular, typically all rod spacings are made equal to provide a square grid appearance; however, the practice of this invention is adaptable to various alternative grid patterns, both uniform and non-uniform.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A wire grid rectangular panel, for use in multiples as panel members of a suspended subceiling of the type in which panel members are supported by a framework of inverted T-bar rails defining an array of like rectangular cell openings, the panel comprising:

four perimeter rod members forming in a lower layer of the panel a rectangular perimeter dimensioned so as to fit within the cell openings;

a plurality of grid rods, in an upper layer, disposed side by side immediately adjacent above said perimeter rod members and attached to at least two opposite ones of said perimeter rod members, the upper layer rods being dimensioned in length to extend beyond said perimeter so as to provide support for said panel upon upper surfaces of bottom flanges of said T-bar rails;

a plurality of grid rods, within the perimeter in the lower layer, disposed side by side, non-parallel to said the rods in the upper layer, so as to form a grid pattern in combination therewith;

whereby said panel, when placed within a cell of the support framework, is caused to become constrained in an installed position such that said perimeter cooperates spatially with corresponding adjacent rail flanges to form a uniform visual border along all four edges of the panel.

2. The wire grid panel as defined in claim 1 wherein said rods are made of steel and are joined by welding at the crossing intersections.

3. The wire grid panel as defined in claim 1 wherein said grid rods within the perimeter in the lower layer are disposed parallel to a pair of opposed rods of said perimeter and said grid rods in the upper layer are disposed perpendicular to said rods within the perimeter in the lower layer.

4. The wire grid panel as defined in claim 2 wherein said lower layer grid rods are spaced apart equally and said upper layer rods are spaced apart equally.

5. The wire grid panel as defined in claim 4 wherein spacings between rods in the lower layer are made equal to spacings between rods in the upper layer so as to form a square grid pattern.

6. The wire grid panel as defined in claim 5 wherein the panel is made to fit into a substantially square support framework cell opening, and wherein said lower layer comprises a first quantity of like parallel rods in addition to two transverse end rods, and said upper layer comprises a second quantity of parallel rods, the first quantity being two greater than the second quantity.

7. The wire grid panel as defined in claim 5 wherein said upper layer comprises four parallel rods and said lower layer comprises six parallel rods and two transverse end rods.

8. A wire grid rectangular panel for use in multiples as panel members of a suspended subceiling of the type in which panel members are supported by a framework of inverted T-bar rails defining an array of like rectangular cell openings, the panel comprising:

a first array of adjacent parallel elongated cylindrical rods disposed in a first horizontal layer;

a second array of adjacent elongated cylindrical rods, non-parallel to the rods in the first array, disposed in a second layer immediately beneath said first layer, and attached thereto; and a pair of elongated cylindrical end rods in the second layer, parallel to said rods in the first layer, disposed transversely and attached, one across each end of said second array;

the rods in the first array being dimensioned in length to extend beyond two opposed edges of said second array and thus provide support for said panel on upper surfaces of flanges of the T-bar rail such that said end rods and an outermost pair of rods in said second array are caused to define a rod perimeter fitted within said cell openings, immediately adjacent to support rail flanges at all four edges thereof.

* * * * *